US007070262B2

(12) United States Patent
Yamamoto et al.

(10) Patent No.: US 7,070,262 B2
(45) Date of Patent: Jul. 4, 2006

(54) DROPLET EJECTING HEAD

(75) Inventors: Ryoichi Yamamoto, Kanagawa (JP); Kenichi Kodama, Kanagawa (JP); Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 288 days.

(21) Appl. No.: 10/766,904

(22) Filed: Jan. 30, 2004

(65) Prior Publication Data

US 2004/0207692 A1 Oct. 21, 2004

(30) Foreign Application Priority Data

Jan. 31, 2003 (JP) ..... 2003-024266

(51) Int. Cl.
*B41J 2/05* (2006.01)

(52) U.S. Cl. ..... 347/63; 347/56; 347/100

(58) Field of Classification Search ..... 347/20, 347/56, 61–65, 67, 44, 47, 100
See application file for complete search history.

(56) References Cited

U.S. PATENT DOCUMENTS 5,750,592 A * 5/1998 Shinozuka et al. ..... 347/100
5,753,016 A * 5/1998 Hayashi et al. ..... 347/100
6,003,978 A 12/1999 Asakawa et al. ..... 347/65
6,443,561 B1 * 9/2002 Murakami ..... 347/63

FOREIGN PATENT DOCUMENTS

JP 9-327918 12/1997
JP 11-10878 1/1999

* cited by examiner

*Primary Examiner*—Juanita D. Stephens
(74) *Attorney, Agent, or Firm*—Whitham, Curtis, Christofferson & Cook PC

(57) ABSTRACT

The droplet ejecting head includes heating elements each of which has a thermal energy applying surface which imparts energy to a viscous fluid with a viscosity of at least 20 mPa·sec so as to evolve a bubble, fluid supply channels each of which has the heating element on a wall and supplies the fluid toward the heating element and ejection nozzles through each of which the fluid is ejected as a droplet and each of which is in a position opposite the energy applying surface of the heating element across the supply channel. A distance between the energy applying surface and a foremost end of the ejection nozzle from which the droplet is ejected is in a range of from 2 μm to 8 μm or the distance is smaller than a growth height of the bubble that has evolved in the fluid by means of the heating element and which has been left to expand by itself until its internal pressure once exceeding one atmosphere decreases to a point below one atmosphere.

11 Claims, 3 Drawing Sheets

DROPLET EJECTING HEAD

BACKGROUND OF THE INVENTION

This invention relates to a droplet ejecting head which heats a viscous fluid with heating elements to produce bubbles that cause the fluid to be ejected as droplets.

One of the inkjet printers that have become popular today are of a type that uses a thermal inkjet printer head in which part of ink is abruptly heated to form a bubble in the ink and ink droplets are propelled and ejected by the expansion force of the bubbles formed in the ink. With this type of ink jet printers, high quality image can be easily printed on recording paper. However, the recording paper for use in printing is mainly of dedicated type which is comparatively expensive and if plain paper having fairly high water absorbency is used, ink that has struck the surface of the paper will blot there, making it occasionally impossible to print high quality image.

In order to solve this problem, one may think of employing ink of comparatively high viscosity so that it will not blot even if it is printed on plain paper but then it becomes necessary to ensure accurate ejection of the highly viscous ink. JP 11-10878 A and JP 9-327918 A propose inkjet printer heads that employ ink of high viscosity.

The inkjet printer head disclosed in JP 11-10878 A comprises an ejection port through which ink is ejected, a first heating element which is provided in association with the ejection port and which heats the ink to form a bubble that ejects it, and a second heating element that is adjacent to the first heating element and which is dedicated to heating the ink. Because of such construction, JP 11-10878 A says, ink of high viscosity can be rendered less viscous by heating so that high refill characteristics are realized with high efficiency and meniscus is sufficiently stabilized to provide improved print quality.

The fluid ejecting head disclosed in JP 9-327918 A is characterized by providing a moving member that faces a foaming region where a bubble is to be formed so that the two fluid channels spaced apart by the moving member will have different internal pressures. A foaming fluid that is to form a bubble and an ejection fluid that is to be ejected as a droplet are supplied into separate fluid channels and the bubble formed in the foaming fluid moves the moving member, causing the ejection fluid to be ejected. Because of this design, JP 9-327918 A says, ink of high viscosity can be supplied in a consistent manner and the fluid that forms a bubble can be refilled with higher efficiency.

However, the inkjet printer head disclosed in JP 11-10878 A suffers the problem of being costly since it has at least two heating elements. What is more, the use of plural heating elements is susceptible to defects and the service life of the head is prone to be shortened.

The fluid ejecting head disclosed in JP 9-327918 A has two fluid channels spaced apart by the moving member and they are adapted to have different internal pressures. This complicates the structure of the head, not only shortening its service life but also increasing the production cost.

SUMMARY OF THE INVENTION

The present invention has been accomplished in order to solve the aforementioned problems of the prior art and has as an object providing a droplet ejecting head that is less costly, no more complicated in structure than the conventional inkjet printer head and which yet allows a fluid of high viscosity to be ejected in droplets with high efficiency.

In order to attain the object described above, the present invention provides a droplet ejecting head comprising: first heating elements, each having a thermal energy applying surface which imparts energy to a viscous fluid with a viscosity of at least 20 mPa·sec so as to evolve a bubble; fluid supply channels, each having the first heating element on a wall and supplying said viscous fluid toward said first heating element; and ejection nozzles through each of which said viscous fluid is ejected as a droplet and each of which is in a position opposite the thermal energy applying surface of said first heating element across the fluid supply channel, wherein a distance between said thermal energy applying surface and a foremost end of the ejection nozzle from which the droplet is ejected is in a range of from 2 μm to 8 μm.

In order to attain the object described above, the present invention provides a droplet ejecting head comprising: first heating elements, each having a thermal energy applying surface which imparts energy to a viscous fluid with a viscosity of at least 20 mPa·sec so as to a evolve bubble; fluid supply channels, each having the first heating element on a wall and supplying said viscous fluid toward said first heating element; and ejection nozzles through each of which said viscous fluid is ejected as a droplet and each of which is in a position opposite the thermal energy applying surface of said first heating element across the fluid supply channel, wherein a distance between said thermal energy applying surface and a foremost end of the ejection nozzle from which the droplet is ejected is smaller than a growth height of the bubble that has evolved in said viscous fluid by means of said first heating element and which has been left to expand by itself until its internal pressure once exceeding one atmosphere decreases to a point below one atmosphere.

Preferably, the distance between said thermal energy applying surface and said foremost end of said ejection nozzle from which the droplet is ejected is in a range of from 2 μm to 8 μm.

In each of the embodiments described above, it is preferable that a cross section of said ejection nozzle parallel to its ejecting surface has a smaller area than said thermal energy applying surface of said first heating element irrespective of a position at which the cross section of the ejection nozzle is taken. Preferably, a cross section of said ejection nozzle parallel to its ejecting surface becomes smaller as it is taken in a position closer to the foremost end of said ejection nozzle from which the droplet is ejected.

Preferably, the ejection nozzle is bored through a plate and a heat generating means for heating said viscous fluid is provided on the plate near the foremost end of said ejection nozzle from which the droplet is ejected. Preferably, the heat generating means is a second group of heating elements that selectively generate heat and which are respectively provided in at least two segmented areas of said plate along perimeter of said ejection nozzle.

The first heating element may be formed on the substrate, the fluid supply channel may be defined by the spacer layer placed over the substrate, and the ejection nozzle may be formed by making holes through a film-like plate attached to the spacer layer.

DESCRIPTION OF THE PREFERRED EMBODIMENTS

On the pages that follow, the droplet ejecting head of the invention is described in detail with reference to the preferred embodiments depicted in the accompanying drawings.

Figure 1A:
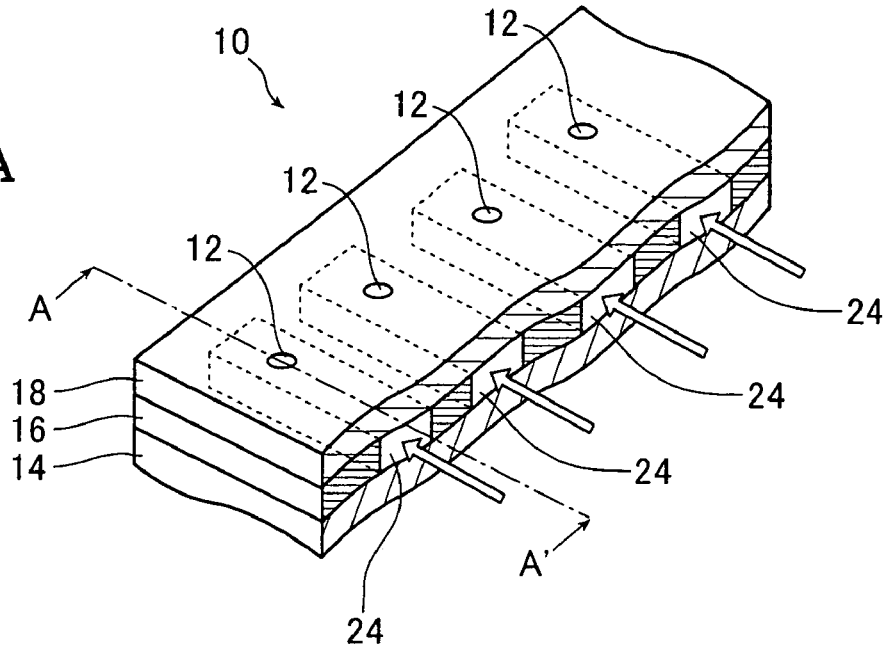
FIG. 1A is a perspective view showing diagrammatically an embodiment of the droplet ejecting head of the invention.
Figure 1B:
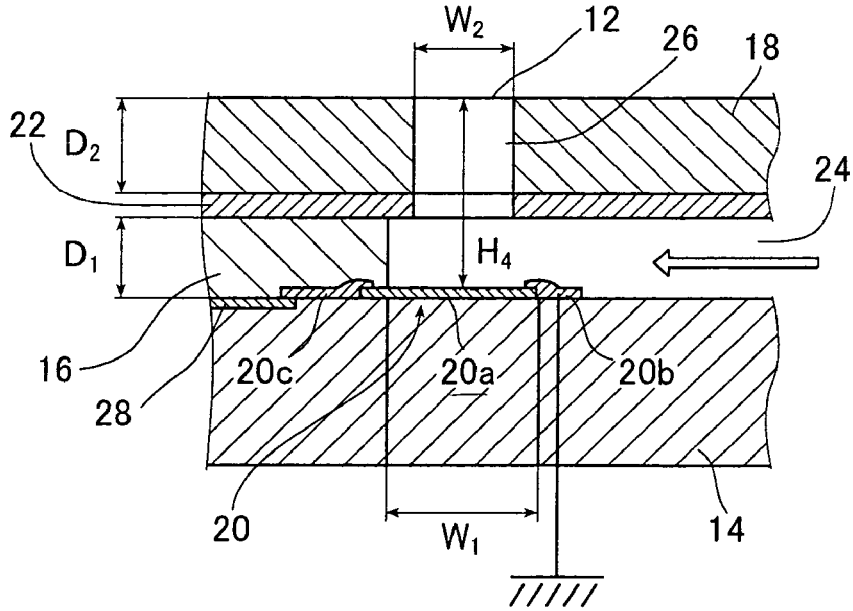
FIG. 1B is section A–A' of the head shown in FIG. 1A.

FIG. 1A is a perspective view showing diagrammatically an exemplary droplet ejecting head 10 according to the invention and FIG. 1B is section A–A' of the droplet ejecting head 10 shown in FIG. 1A.

The droplet ejecting head 10 has a number of circular ejection ports 12 formed in one direction at specified intervals and through those ejection ports 12, droplets of a fluid more viscous than the ink commonly used on inkjet printer heads are ejected. Each ejection port 12 has an ejection unit that is so designed that droplets are ejected through the ejection port 12.

The droplet ejecting head 10 mainly comprises a Si substrate 14, a spacer layer 16 and a nozzle plate 18.

As shown in FIG. 1B, a heating element 20 (a first heating element) is formed on a surface of the Si substrate 14 and it has a heating surface (a thermal energy applying surface) by means of which a viscous fluid having a viscosity of at least 20 mPa·sec is given thermal energy to boil locally and form a bubble. The Si substrate 14 is overlaid with the spacer layer 16 which in turn is overlaid with the nozzle plate 18 to construct the droplet ejecting head 10.

The spacer layer 16 and the nozzle plate 18 are bonded together by means of an adhesive layer 22 formed by applying a heat-curable adhesive to the nozzle plate 18.

The spacer layer 16 is provided by first applying a light-sensitive polyimide having a viscosity of about 100 mPa·sec to the Si substrate 14 and patterning the applied polyimide film by dry photo-etching in such a way as to form desired ink supply channels 24. The spacer layer 16 is typically 2 μm thick. The spacer layer 16, the Si substrate 14 and the nozzle plate 18 in combination define walls of the fluid supply channels 24; the heating elements 20 formed on the Si substrate 14 also serve as part of the walls of the fluid supply channels 24. The ink supply channels 24 communicate with a fluid reservoir (not shown) such that the fluid is kept supplied to the heating elements 20 via the fluid supply channels 24.

The heat-curable adhesive is not the only adhesive that can be used to form the adhesive layer 22 which bonds the spacer layer 16 to the nozzle plate 18 and a uv-curable adhesive or a thermoplastic adhesive may also be employed.

The nozzle plate 18 is typically made of Aramid or the like and has a thickness of, say, 2 μm. Extending through the thickness of the nozzle plate 18 is a cylindrical ejection nozzle 26 that has an ejection port 12 open at the fluid ejection end and which is located opposite the heating element 20 across the ink supply channel 24.

Aside from Aramid, the nozzle plate 18 may be a polymer film made of PEN (polyether nitrile), polyimide, etc.

The heating element 20 formed on the Si substrate 14 may have a heat insulation layer (not shown) as the bottommost layer which is made of $Ta_2O_5$, $SiO_2$, etc. and overlaid with a heating resistor 20*a* having the composition Ta—Si—O, which in turn is partly overlaid with electrodes 20*b* and 20*c* which are made of Ni and through which voltage is applied to the heating resistor 20*a*. The heat insulation layer, the heating resistor 20*a* and the electrodes 20*b* and 20*c* combine together to form the heating element which, upon application of voltage to the heating resistor 20*a*, heats that part of the fluid flowing through the ink supply channel 24 which is in the neighborhood of the heating resistor 20*a*. The surface of each heating resistor 20*a* may be covered with a self-oxidizing film of its own which typically is not thicker than 0.1 μm. Alternatively, a protective film resistant to electrolytic corrosion or cavitation may be provided in a thickness not greater than 0.1 μm.

The composition of the resistor 20*a* is not limited to Ta—Si—O; it may also be made of metallic Ta alone or it may be a resistor having such a composition as Ta—N.

The electrode 20*b* as well as similar electrodes 20*b* of other ejection units are put together into a common electrode which is connected to the ground. The electrode 20*c* is connected to a drive circuit 28 formed on the Si substrate 14 such that a pulse signal generated in the drive circuit 28 is supplied to the electrode 20*c*. The spacer layer 16 covers both the electrode 20*c* and part of the resistor 20*a*. The thermal energy applying surface of the heating element 20 which heats the fluid flowing in the fluid supply channel 24 has a width $W_1$ which is greater than $W_2$, or the diameter of the ejection port 12, so the area of the thermal energy applying surface is greater than that of the circular ejecting surface of the ejection port 12. For instance, width $W_1$ is typically set at 18 μm and diameter $W_2$ at 15 μm. This is in order to ensure that a bubble formed in the neighborhood of the thermal energy applying surface grows big enough to plug the ejection port 12 and effect complete severing between the part of the fluid to be ejected and the part to remain, so that as will be described later in the specification, the highly viscous fluid to be ejected is entirely ejected using the bubble that has expanded to build up a pressure in excess of one atmosphere.

As a result, when the fluid supplied through the fluid supply channel 24 is heated with the heating element 20, a bubble is formed in the neighborhood of the heating element 20 and the fluid can be ejected as a droplet from the ejection port 12 of the ejection nozzle 26 by the expansion force of the bubble having an internal pressure in excess of one atmosphere.

In the embodiment under consideration, the spacer layer 16 has a thickness $D_1$ of 2 μm and the nozzle plate 18 has a thickness $D_2$ of 2 μm. The thickness of the heating element 20 itself is several hundred nanometers. Therefore, the height $H_4$ of the heating element 20 as measured from its thermal energy applying surface (heating surface) to the ejection port 12 is between 2 μm and 4 μm. The value of $H_4$ is little dependent on the thickness of the adhesive layer 22 since the spacer layer 16 is buried in the adhesive layer 22 when it is bonded to the film serving as the nozzle plate 18.

In the present invention, if $D_1$ and $D_2$ are so adjusted that $H_4$ is within the range of 2–8 μm, a viscous fluid having a viscosity of at least 20 mPa·sec is given sufficient thermal energy that it is efficiently ejected in droplets as will be explained later.

The height $H_4$ of the heating element 20 as measured from its energy applying surface to the ejection port 12 is set between 2 μm and 8 μm in order to ensure that before the internal pressure of the bubble formed in the highly viscous fluid drops below one atmosphere as it expands, communication with the atmosphere is established and the highly viscous fluid is efficiently ejected as a droplet. If $H_4$ is greater than 8 μm, the highly viscous fluid cannot be ejected as droplets even if it is heated with the heating element 20. If $H_4$ is smaller than 2 μm, the cross-sectional area of the fluid supply channel 24 decreases to increase the flow resistance of the fluid and, as a result, the fluid is not supplied rapidly enough that consistent refilling of the fluid cannot be performed in an adequate amount that just compensates for the ejection of a droplet. To be more specific, numerical calculations based on CFD (computer fluid dynamics) have shown that when a bubble formed in a viscous fluid by means of the heating element 20 was left to expand by itself, its internal pressure once exceeding one atmosphere decreased to a point below than one atmosphere when it grew to a height in excess of 10 μm for the case where the fluid had a viscosity between 20 mPa·sec and 100 mPa·sec.

On the basis of this finding, the bubble formed in the viscous fluid can be grown to reach the neighborhood of the ejection port 12 at a stage where its internal pressure exceeds one atmosphere; as a result, the bubble is allowed to communicate with the atmosphere and the viscous fluid having a viscosity up to about 100 mPa·sec can be ejected as energetic droplets with an internal pressure in excess of one atmosphere.

If the fluid's viscosity exceeds 100 mPa·sec, the growth speed of the bubble formed in it will decrease and the fluid to be ejected will experience greater viscosity resistance when it passes through the ejection nozzle 26, thus making it impossible to perform consistent ejection of droplets.

In the droplet ejecting head 10 described above, the fluid having a viscosity of at least 20 mPa·sec which is supplied from a fluid reservoir (not shown) via the fluid supply channel 24 boils locally to form a bubble by the heat generated from the thermal energy applying surface of the heating element 20. Since the heating element 20 effects very brief heating by application of impulses, heating with the heating element 20 will end during the expansion of the bubble formed in the fluid and the subsequent stage of expansion is adiabatic, causing a gradual decrease in the internal pressure of the bubble. However, since the height $H_4$ of the heating element 20 as measured from its energy applying surface to the ejection port 12 is set between 2 μm and 8 μm, the bubble that was formed in the fluid and which has expanded to have an internal pressure exceeding one atmosphere is constrained by the shape of the ejection nozzle 26 and severs the fluid into two portions, one that remains in the fluid supply channel and the other to be ejected, while growing to reach the neighborhood of the ejection port 12 where it communicates with the atmosphere at the stage where its internal pressure is in excess of one atmosphere, so that the fluid of high viscosity which is to be ejected can be ejected efficiently as droplets.

The nozzle plate 18 is an extremely thin film member whose thickness $D_2$ is only 2 μm. Since attaching such a thin film involves considerable difficulty, the following approach may be adopted: an easy-to-handle film thicker than 2 μm is preliminarily attached to the spacer layer 16 by means of an adhesive; after curing the adhesive, the entire surface of the film is dry etched to a uniform small thickness, thereby forming the desired thin film at a thickness of 2 μm. Subsequently, this film may be covered with a silicone based photoresist as a mask in areas other than the nozzle forming positions and reactive ion etching is applied to form ejection nozzles 16. Since photoresist mask patterning is performed using semiconductor process technologies through accurate registration with reference to, for example, a register pattern printed on the Si substrate 14, the ejection nozzles 26 can be formed in accurate positions by dry etching.

In the droplet ejecting head 10, the ejection nozzle 26 is cylindrical and has a constant cross section. This is not the sole case of the invention and as shown in FIG. 2, a droplet ejecting head 50 may be designed such that the cross section of an ejection nozzle 56 which is parallel to the ejection surface becomes smaller as it is taken in a position closer to the foremost end of the ejecting direction (i.e., the ejection port 52).

Figure 2:
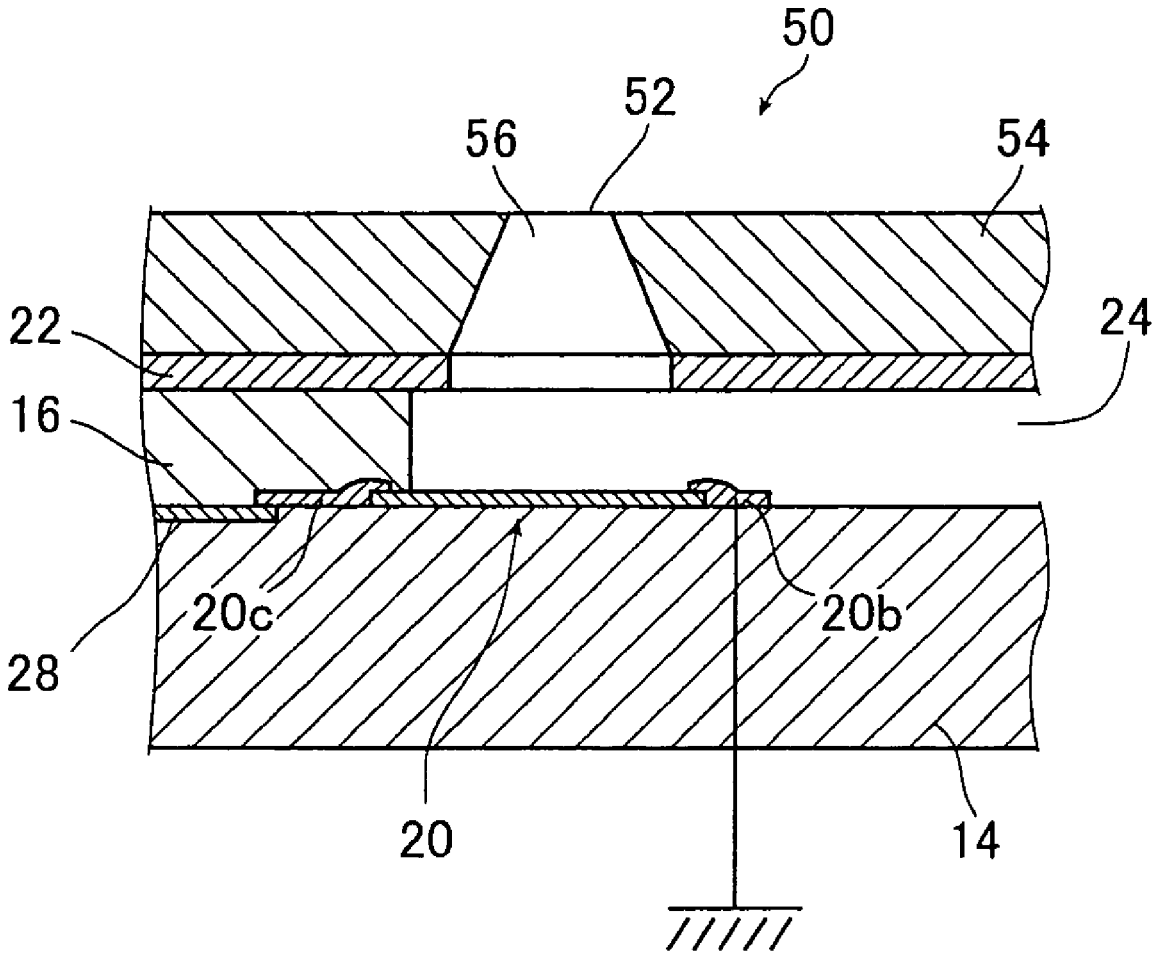
FIG. 2 is a sectional view showing another embodiment of the droplet ejecting head of the invention.

The droplet ejecting head 50 shown in FIG. 2 has an identical construction to the droplet ejecting head 10 except for the nozzle plate 54. Hence, like parts are identified by like numerals and will not be described in detail. In the illustrated case, too, the height of the heating element 20 as measured from its thermal energy applying surface to the ejection port 52 is set between 2 μm and 8 μm and the cross section of the ejection nozzle 56 parallel to the ejecting surface has a smaller area than the energy applying surface of the heating element 20 irrespective of the position at which a cross section of the nozzle is taken. Since the height of the heating element 20 as measured from its energy applying surface to the ejection port 52 is set between 2 μm and 8 μm, the bubble that was formed in the fluid and which has expanded to have an internal pressure exceeding one atmosphere is constrained by the shape of the ejection nozzle 56 and severs the fluid into two portions, one that remains in the fluid supply channel and the other to be ejected, while growing to reach the neighborhood of the ejection port 52. What is more, the cross section of the ejection nozzle 56 becomes smaller as it is taken in a position closer to the foremost end of the ejecting direction, so the expansion force of the bubble increases sufficiently to enhance the intensity of propulsion of the fluid to be rejected. As a result, the fluid of high viscosity which is to be ejected can be ejected more efficiently as droplets. Particularly efficient is the ejection of fluids having viscosities up to about 100 mPa·sec.

Figure 3A:
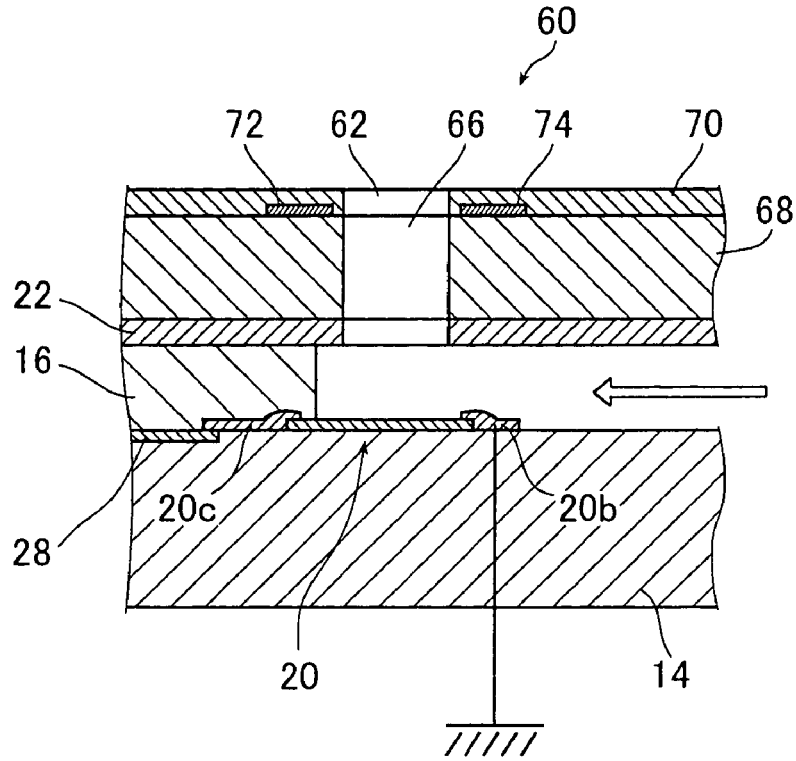
FIG. 3A is a sectional view showing yet another embodiment of the droplet ejecting head of the invention which is different from the embodiment depicted in FIG. 2.
Figure 3B:
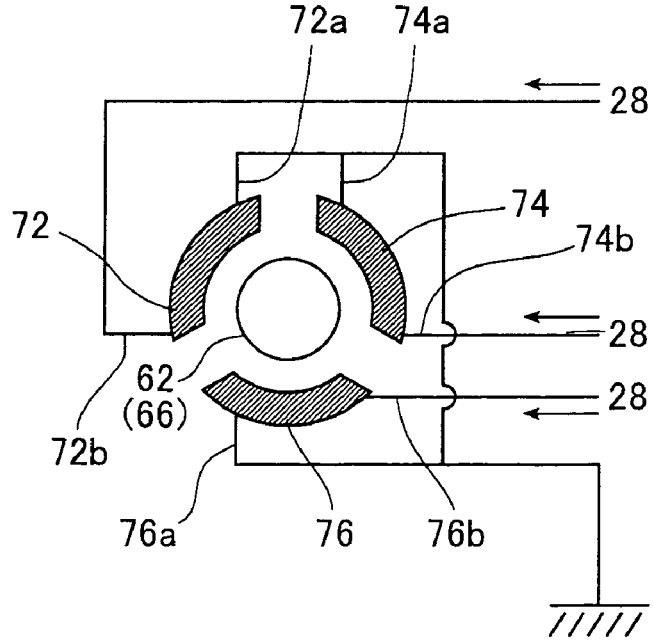
FIG. 3B illustrates heating elements provided around an ejection port in the nozzle plate depicted in FIG. 3A.

FIGS. 3A and 3B show yet another embodiment of the droplet ejecting head of the invention which is generally indicated by 60.

Again, the droplet ejecting head 60 has an identical construction to the droplet ejecting head 10 except for the nozzle plate 68. Hence, like parts are identified by like numerals to those used in FIG. 1B and will not be described in detail.

Basically, the nozzle plate 68 is a film that is bonded to the spacer layer 16 by means of the adhesive layer 22. As in the case of the nozzle plate 18, the nozzle plate 68 is an Aramid film. Aside from Aramid, the nozzle plate 68 may be a polymer film made of PEN (polyether nitrile), polyimide, etc.

The nozzle plate 68 has a $SiO_2$ insulation film 70 formed on it in a thickness of about 0.5 μm. Formed in the insulation film 70 are three resistors 72, 74 and 76 that are made of the same material as the resistor 20*a* in the heating element 20 and which are positioned equidistantly around the ejection port 62. The resistors 72, 74 and 76 are connected to grounding wires 72*a*, 74*a* and 76*a*, respectively; they are also connected to signal lines 72*b*, 74*b* and 76*b*, respectively. The grounding wires 72*a*, 74*a* and 76*a* are grounded whereas the signal lines 72*b*, 74*b* and 76*b* are connected to the drive circuit 28. The signal lines 72*b*, 74*b* and 76*b* are selectively supplied with a predetermined signal from the drive circuit 28, causing one of the resistors to heat a selected part of the perimeter of the ejection port 62 at a time. Thus, the resistors 72, 74 and 74 provide a plurality of heaters (a second group of heating elements).

Stated briefly, those heating elements are provided in the respective three segmented areas around the ejection nozzle 66 extending through the nozzle plate 68 and they are connected to the drive circuit 28 to effect selective heat generation.

The grounding wires 72*a*, 74*a* and 76*a* as well as the signal lines 72*b*, 74*b* and 76*b* are typically aluminum conductors having a feature width of 5 μm and a thickness of 0.8 μm. Needless to say, those wires and lines may be formed of a metal material of low resistance such as Ni or Au. Instead of $SiO_2$, the insulation film 70 may be formed of polyimides or fluorinated resins such as CYTOPT™ (product of Asahi Glass Co., Ltd.). In this alternative case, the film thickness is preferably no more than 0.5 μm.

As described above, the droplet ejecting head 60 has the heating elements formed in the respective three segmented areas around each of the ejection ports 62 in the nozzle plate 68, so the fluid around the ejection port 62 of the ejection nozzle 66 can be locally heated to control the flow of the fluid located near the area of the ejection nozzle 66 being heated; as a result, even if the shape of one ejection nozzle 66 is subtly different from the shape of another nozzle, causing droplets to be ejected in different directions, the direction of droplets being ejected of the respective ejection nozzles 66 can be adjusted by the heat generated from the heating elements. This is particularly effective for highly viscous fluids which are of such a type that the slightest error in the dimensional precision of ejection nozzles can cause variations in the direction of droplet ejection.

The heating elements for adjusting the direction of droplet ejection may control heat generation by regulating its duration or intensity. The heating elements suffice to be provided by dividing the perimeter of the ejection port 62 into at least two areas. In order to adjust the droplet ejection in two directions, the perimeter of each ejection port 62 is preferably segmented into at least three areas.

In order to make the nozzle plate 68, the following procedure may be taken after forming a patterned spacer layer 16 on the Si substrate 14: an easy-to-handle film thicker than 2 μm is attached to the spacer layer 16 by means of an adhesive; after curing the adhesive, the entire surface of the film is dry etched to a uniform small thickness, thereby forming the desired thin film at a thickness of 2 μm. Thereafter, the grounding wires 72*a*, 74*a* and 76*a*, the resistors 72, 74 and 76, as well as the signal lines 72*b*, 74*b* and 76*b* are patterned into the surface of the film. Patterning can be performed by known methods. For example, a layer comprising the grounding wires, signal lines or resistors is first formed by sputtering, then a resist is applied and a desired mask is formed by photolithography, and the layer is subsequently etched to form the grounding wires 72*a*, 74*a* and 76*a*, resistors 72, 74 and 76, or signal lines 72*b*, 74*b* and 76*b* in predetermined shapes.

Thereafter, the resist is stripped, the insulation film 70 is formed as an insulation layer, and this film is masked with a silicone based photoresist in areas other than the nozzle forming positions and reactive ion etching is applied to form the ejection nozzles 16.

During nozzle formation, holes are also made through the insulation film 70 by reactive ion etching. To this end, the same dry etching apparatus as used in boring holes through the film serving as the nozzle plate 68 by ion etching may be employed to perform etching using $CF_4$ as a reactive gas. If polyimides or fluorinated resins such as CYTOP™ are used in the insulation film 70 in place of $SiO_2$, the film serving as the nozzle plate 68 may be etched by the same dry etching apparatus using the same reactive gas.

As will be apparent from the foregoing description, the droplet ejecting head 60 has a rather complex construction since the ejection unit of the construction shown in FIG. 3A has heating elements formed around the ejection nozzle 66 to control the direction of droplet ejection. Nevertheless, the head has as many as 300 ejection units arranged per inch in one direction.

While the droplet ejecting head of the invention has been described above in detail, it should be noted that the invention is by no means limited to the foregoing embodiments and various improvements and modifications can of course be made without departing from the scope and spirit of the invention.

As described above in detail, the droplet ejecting head of the invention is characterized in that the height of the ejection nozzle as measured from its thermal energy applying surface (which imparts thermal energy to a fluid having a viscosity of at least 20 mPa·sec to evolve bubbles) to its foremost end from which a droplet is ejected is smaller than the growth height of a bubble that has evolved in the fluid by means of the thermal energy applying surface and which has been left to expand by itself until its internal pressure once exceeding one atmosphere decreases to a point below one atmosphere. Hence, the droplet ejecting head of the invention is less costly, no more complicated in structure than the conventional inkjet printer head and yet it allows the fluid of high viscosity to be ejected in droplets with high efficiency.

If desired, the nozzle plate in the droplet ejecting head having the above-described construction may be so designed that heating elements are formed on the perimeter of the ejection nozzle to divide it into at least two segmented areas. This design offers an additional advantage that even if the shape of one ejection nozzle is subtly different from the shape of another nozzle, causing droplets to be ejected in different directions, the direction of droplets being ejected of the respective ejection nozzles can be adjusted appropriately.

What is claimed is:

1. A droplet ejecting head comprising:

first heating elements, each having a thermal energy applying surface which imparts energy to a viscous fluid with a viscosity of at least 20 mPa·sec so as to evolve a bubble;

fluid supply channels, each having the first heating element on a wall and supplying said viscous fluid toward said first heating element; and ejection nozzles through each of which said viscous fluid is ejected as a droplet and each of which is in a position opposite the thermal energy applying surface of said first heating element across the fluid supply channel, wherein a distance between said thermal energy applying surface and a foremost end of the ejection nozzle from which the droplet is ejected is in a range of from 2 μm to 8 μm.

2. The droplet ejecting head according to claim 1, wherein a cross section of said ejection nozzle parallel to its ejecting surface has a smaller area than said thermal energy applying surface of said first heating element irrespective of a position at which the cross section of the ejection nozzle is taken.

3. The droplet ejecting head according to claim 1, wherein a cross section of said ejection nozzle parallel to its ejecting surface becomes smaller as it is taken in a position closer to the foremost end of said ejection nozzle from which the droplet is ejected.

4. The droplet ejecting head according to claim 1, wherein said ejection nozzle is bored through a plate and a heat generating means for heating said viscous fluid is provided on the plate near the foremost end of said ejection nozzle from which the droplet is ejected.

5. The droplet ejecting head according to claim 4, wherein said heat generating means is a second group of heating elements that selectively generate heat and which are respectively provided in at least two segmented areas of said plate along perimeter of said ejection nozzle.

6. A droplet ejecting head comprising:

first heating elements, each having a thermal energy applying surface which imparts energy to a viscous fluid with a viscosity of at least 20 mPa·sec so as to a evolve bubble;

fluid supply channels, each having the first heating element on a wall and supplying said viscous fluid toward said first heating element; and ejection nozzles through each of which said viscous fluid is ejected as a droplet and each of which is in a position opposite the thermal energy applying surface of said first heating element across the fluid supply channel, wherein a distance between said thermal energy applying surface and a foremost end of the ejection nozzle from which the droplet is ejected is smaller than a growth height of the bubble that has evolved in said viscous fluid by means of said first heating element and which has been left to expand by itself until its internal pressure once exceeding one atmosphere decreases to a point below one atmosphere.

7. The droplet ejecting head according to claim 6, wherein said distance between said thermal energy applying surface and said foremost end of said ejection nozzle from which the droplet is ejected is in a range of from 2 μm to 8 μm.

8. The droplet ejecting head according to claim 6, wherein a cross section of said ejection nozzle parallel to its ejecting surface has a smaller area than said thermal energy applying surface of said first heating element irrespective of a position at which the cross section of the ejection nozzle is taken.

9. The droplet ejecting head according to claim 6, wherein a cross section of said ejection nozzle parallel to its ejecting surface becomes smaller as it is taken in a position closer to the foremost end of said ejection nozzle from which the droplet is ejected.

10. The droplet ejecting head according to claim 6, wherein said ejection nozzle is bored through a plate and a heat generating means for heating said viscous fluid is provided on the plate near the foremost end of said ejection nozzle from which the droplet is ejected.

11. The droplet ejecting head according to claim 10, wherein said heat generating means is a second group of heating elements that selectively generate heat and which are respectively provided in at least two segmented areas of said plate along perimeter of said ejection nozzle.

* * * * *